United States Patent [19]

Rosenthal et al.

[11] Patent Number: 4,598,534

[45] **Date of Patent: * Jul. 8, 1986**

[54] APPARATUS AND METHOD FOR CONVEYING, WEIGHING AND ROLL WRAPPING ARTICLES

[75] Inventors: Henry Rosenthal; Howard E. Kronhaus, both of Boca Raton, Fla.

[73] Assignee: Ha Di Ho, Pompano Beach, Fla.

[ * ] Notice: The portion of the term of this patent subsequent to May 27, 2003 has been disclaimed.

[21] Appl. No.: 717,420

[22] Filed: Mar. 29, 1985

Related U.S. Application Data

[63] Continuation-in-part of Ser. No. 645,712, Aug. 30, 1984.

[51] Int. Cl.[4] ..... B65B 11/00

[52] U.S. Cl. ..... 53/588; 53/211

[58] Field of Search ..... 53/204, 210, 211, 216, 53/225, 502, 588

[56] References Cited

U.S. PATENT DOCUMENTS

| | | | |
|---|---|---|---|
| 4,085,566 | 4/1978 | Crowe et al. | 53/124 |
| 4,281,500 | 8/1981 | Mueller et al. | 53/211 |
| 4,362,001 | 12/1982 | Cockerham, Jr. et al. | 53/441 |
| 4,458,470 | 7/1984 | Fine | 53/502 |
| 4,480,422 | 11/1984 | Meives et al. | 53/207 |
| 4,498,276 | 2/1985 | Reed | 53/588 |

FOREIGN PATENT DOCUMENTS

| | | | |
|---|---|---|---|
| 79321 | 5/1983 | European Pat. Off. | 53/211 |
| 2021510 | 12/1979 | United Kingdom | 53/211 |
| 2056401 | 3/1981 | United Kingdom | 53/211 |

OTHER PUBLICATIONS

Mark's Standard Handbook for Mechanical Engineers (8th ed.), pp. 5.58–5.59 and 16.4.

*Primary Examiner*—John Sipos
*Assistant Examiner*—Steven P. Weihrouch
*Attorney, Agent, or Firm*—Pennie & Edmonds

[57] ABSTRACT

An apparatus and method are disclosed for transporting, weighing, and roll wrapping articles with a stretchable web-type material. The apparatus includes horizontal conveyor means and article support rollers supported on a rotatable table. The support rollers being quickly adjustably movable equidistantly toward and away from each other to accommodate articles of numerous sizes and weights while maintaining the center of gravity of the article generally centrally positioned with respect to the support rollers and the rotatable table.

34 Claims, 6 Drawing Figures

APPARATUS AND METHOD FOR CONVEYING, WEIGHING AND ROLL WRAPPING ARTICLES

CROSS REFERENCE TO RELATED APPLICATIONS

This application is a continuation-in-part of Ser. No. 645,712, filed Aug. 30, 1984.

FIELD OF THE INVENTION

The present invention relates to an improved apparatus for roll wrapping articles wherein the article is first supported and transported on a conveyor section to a second conveyor section which positions the article on horizontally rotatable support rollers on a rotatable platform, such that the article is rotated about two mutually perpendicular axes while being wrapped. Thereafter, the article is once again deposited on a conveyor for transporting the wrapped article away from the support rollers.

BACKGROUND OF THE INVENTION

Roll wrapping devices of the prior art generally rotate the article to be wrapped, while a stretchable web or netting material such as thermoplastic film or cloth, or a relatively non-stretchable web material such as paper, is dispensed for wrapping therearound. In the apparatus of the type contemplated by the invention, two support rollers are generally positioned on a horizontal ("lazy susan type") rotatable table while the article is simultaneously rotated about its own horizontal axis. The support rollers are often spaced to accommodate articles of several sizes.

Such devices in the past, have been provided with means for increasing the distance between the support rollers by shifting one of the rollers toward or away from the outer support roller, the position of which is fixed. Thus, when the movable roller is shifted outwardly, the center of gravity of the load shifts, causing the danger of shifting the entire apparatus when the article is extremely heavy.

In the prior art devices, the article is wrapped while it is rotated in one direction about its own horizontal axis and simultaneously rotated about a vertical axis by virtue of the rotating platform upon which the support rollers are positioned. Thus, wrapping the article with these devices is not a very precise operation and control of overlap and wrapping direction is not as effective as would otherwise be desirable. Moreover, once the article is wrapped in this manner, it must be removed to a weighing station for weighing. The delivery and removal of the article to be wrapped to and from the roll wrapping apparatus is also deficient in with respect to the time, effort, and handling problems involved.

Thus, in addition to providing a wrapping which leaves something to be desired, the delivery, wrapping, weighing, and removal operations are time consuming procedures which leave room for improvement. I have invented an apparatus for transporting articles to be roll wrapped as well as to an apparatus for roll wrapping such articles which avoids the disadvantages of the prior art.

SUMMARY OF THE INVENTION

The term "web type wrapping material" as used herein includes, but is not limited to, relatively stretchable materials such as thermoplastic webbing, film, or netting and cloth fabric or netting, as well as relatively non-stretchable materials such as paper or cardboard. Other web-type materials contemplated by the invention are known to those skilled in the art.

The present invention relates to an apparatus for transporting and wrapping articles which comprises conveyor means for transporting articles at least to a wrapping apparatus which wraps the article with a web type wrapping material. In an alternate embodiment, the present invention further includes second conveyor means for transporting the articles thereby wrapped away from the wrapping apparatus.

The wrapping apparatus comprises a frame, a platform mounted on the frame for rotation about a substantially vertical axis, at least two elongated support rollers mounted on the rotatable platform for rotation about a substantially horizontal axis extending therethrough, a supply of web type wrapping material mounted on the frame, the wrapping material supply being movably positioned and adapted for dispensing and wrapping about an article supported on the horizontally rotatable rollers as the platform rotates about a vertical axis, means for selectively moving the supply of wrapping material so as to position said wrapping material supply substantially at the center of the article to be wrapped, means for rotatably driving at least one of the substantially horizontal rollers in at least one direction of rotation such that an article to be wrapped rotates about a substantially horizontal axis when the driven support roller is rotated, and the rotating article engages the other supporting horizontal roller and rotates the other support roller in the same direction as the first driven roller, and means for selectively varying the horizontal dimension between the horizontal rotatable support rollers by equal and opposite movements respectively toward and away from each other to maintain the center of gravity of the article in substantially the same location with respect to the frame and thereby providing capability to support articles of numerous sizes and weights.

Preferably, the means for selectively moving the supply of wrapping material further comprises means to selectively move the supply of wrapping material in upward and downward directions so as to selectively vary the vertical height at which the wrapping material is dispensed from the wrapping material supply. Also, the means for rotatably driving the horizontal roller is capable of selective driving rotation in one or two directions.

The apparatus further comprising means for stabilizing the article when positioned upon the support rollers during the wrapping operation. The stabilizing means comprises at least two rollers mounted above the support rollers and capable of rotation about substantially vertical axis. The rotating platform is rotatably supported by the frame and means is positioned between the rotatable platform and the frame for supplying a signal which corresponds to the weight of an article positioned on the support rollers so as to thereby provide the weight of the article.

The means for providing the weight indication is plurality of load cells connected to the apparatus and to an electrical circuit. Preferably, the plurality of load cells are equally distributed with respect to the rotatable platform. Also, the load cells and electrical circuitry comprises means for indicating the weight of the rotatable platform and the article positioned thereon.

Advantageously, the load cells and electrical circuitry comprises means for initially subtracting the weight of the platform and related components from the total indicated weight thereby indicating the weight of the article.

Advantageously, the apparatus further comprises second conveyor means for transporting the articles thereby wrapped away from the wrapping apparatus. Preferably, the first and second conveyor means each is comprised of a plurality of conveyor rollers which are connected together to form a conveyor. Each roller has a generally concave outer configuration in a plane perpendicular to the conveying direction for supporting a generally cylindrical article to be wrapped for transport in a direction parallel to the axis of the article.

Each roller preferably has an hourglass cross-sectional configuration in a plane perpendicular to the conveying direction, and is rotatably supported by bearing means. The rollers can either be free rolling on the bearing means, or rotatably driven in a preselected one or either direction. When the rollers are driven, drive chain means or drive belt means may be used. Also, the drive chain means is driven by rotatably driven sprocket means and the belt means is driven by rotatably driven pulley means.

The first conveyor means can be in two sections: a first conveying section for transporting articles to be wrapped to the wrapping apparatus as well as for conveying a wrapped article away from the wrapping apparatus, and a second conveying section mounted upon the rotatable platform for positioning the article to be wrapped upon the elongated support rollers and for removing the wrapped article from the support rollers.

When first and second conveyor means are used, the overall system comprises three conveyor sections: the first conveyor means comprises a first conveying section for transporting articles to be wrapped the wrapping apparatus, and a second conveying section as described above, while the second conveyor means is a separate conveyor section for transporting wrapped articles away from the wrapping apparatus.

The apparatus of the invention can also include means for positioning the second conveying portion of the conveyor in preselected locations below and above the elongated support rollers to facilitate conveying and positioning of the article to be wrapped upon the elongated support rollers and for removing and conveying the wrapped article from the elongated support rollers. In a preferred arrangement, the second portion of the conveying conveyor is fixed medially between the support rollers.

In the roll wrapping apparatus which forms part of the present invention the rotating platform is rotationally supported by the frame and means is positioned between the rotatable platform and the frame for supplying a signal which corresponds to the weight of an article positioned on the frame so as to thereby provide the weight of the article. The apparatus also includes means for providing the article weight indication in the form of a plurality of load cells connected to an electrical circuit. The plurality of load cells are preferably equally distributed with respect to the rotatable platform, and the electrical circuitry comprises means for indicating the weight of the rotatable platform and the article positioned thereon.

The roll wrapping apparatus also includes means for initially subtracting the weight of the platform from the indicated weight thereby indicating the weight of the article, and at least one of the horizontally rotatable rollers is preferably driven by a motor.

The roller drive motor is connected for driving rotation of the first mentioned support roller by a system of sprockets and at least one drive chain, and the direction of this drive motor is selectively reversible so as to facilitate reversing the direction of the first mentioned driven horizontal support roller and thereby the direction of the article is simultaneously reversed as the platform is rotated about a substantially vertical direction.

Alternatively, any power transmission system may be used. For example, the sprockets and drive chain may be replaced by a system of pulleys and belts, including V-belts, timing belts, or flat belts. Another example of a power transmission system is a system of gears.

The roll wrapping apparatus also includes means for varying the dimension between the horizontally rotatable support rollers in the form of an elongated threaded rod threadedly connected to opposite support roller support members, each roller support member respectively supporting one of the horizontally rotatable rollers for rotation about a horizontal axis extending therethrough. The threaded rod is comprised of two sections separated by a manually operable adjustment means. The two sections of the threaded rod are equally and oppositely threaded and are connected to correspondingly mating threaded members respectively connected to the respective support members of the horizontally rotatable support rollers.

The manual adjustment means comprises a hand operable wheel connected to the rod at its center, such that rotation of the wheel rotates the threaded rod thereby causing the roller support members and the rollers to be moved toward or away from each other in equal and opposite directions in dependence upon the direction of rotation selected for the adjustment wheel for varying the dimension between the horizontal support rollers in dependence upon the dimensions of the article to be wrapped. The rotation of the horizontal platform about a vertical axis combined with the rotation of the horizontal support rollers and the article about its horizontal axis and the selective upward and downward movement of the supply of web-type wrapping material as the wrapping material is dispensed and wrapped about the rotating article combines with the selective reversing rotation of the driven horizontal roller to provide a criss-cross wrapping pattern of the web-type wrapping material about the article.

Alternatively, in place of a hand operable control wheel, an electrically actuated or motorized mechanical adjustment system may be used.

Preferably the web-type wrapping material is in the form of a roll of stretchable wrapping film such as nylon, polypropylene, PVC, polybutylene, polyethylene, or copolymers or blends thereof, cloth, paper, cardboard, or the like, rotatably mounted to dispense material as required. Alternatively, means may be provided to support and dispense the stretchable web-type wrapping materials in a pre-stretched condition.

A method is also disclosed for transporting and roll wrapping articles or the like which comprises transporting articles to be wrapped to a wrapping station and wrapping the articles at the wrapping station by supporting the article on at least two support rollers, at least one of the support rollers being rotatably driven, the other support roller being supported for rotation about a horizontal axis, supporting the support rollers on a rotatable platform selectively driven by motor and drive means connected thereto, providing a supply of web-type wrapping material positioned for dispensing and wrapping about the article, rotating the platform and the article support rollers and thereby the article about a substantially vertical axis, selectively rotating the driven support roller so as to rotate the article and the other support roller therewith, and wrapping the web-type material around the article so as to provide a criss-cross wrapped pattern of wrapping material about the article.

The step of providing a supply of web-type wrapping material further comprises selectively moving the supply in upward and downward directions so as to selectively vary the vertical height at which the supply material is dispensed. Also, the step of selectively rotating the driven support roller further comprises selectively reversing the rotational direction of the driven article support roller as the article rotates about the substantially vertical axis, and as the web-type wrapping material is wrapped therearound.

The method also includes stabilizing the article when positioned upon the support rollers during the wrapping step. Also, the method further comprises rotatably supporting said platform upon a frame and positioning between the platform and frame means for supplying a signal which corresponds to the weight of the article positioned upon the support rollers so as to thereby provide the weight of the article. The step of supplying a signal comprises indicating the weight of the platform and article and subtracting the weight of the platform therefrom to directly obtain the weight of the article.

The method further comprises transporting the articles thereby wrapped away from the wrapping station. Similarly, the method contemplates positioning an article to be wrapped upon the support rollers for wrapping and removing the article thereby wrapped from the support rollers. Also, the step of positioning the article to be wrapped comprises moving conveying means in upward and downward directions.

Preferably, the method of weighing the article is practiced during or after wrapping by ultilizing weighing means comprising load cells and circuitry located on, and connected to, the apparatus.

DETAILED DESCRIPTION OF THE DRAWINGS

Preferred embodiments of the invention are described hereinbelow with reference to the drawings wherein.

DESCRIPTION OF THE PREFERRED EMBODIMENTS

Figure 1:
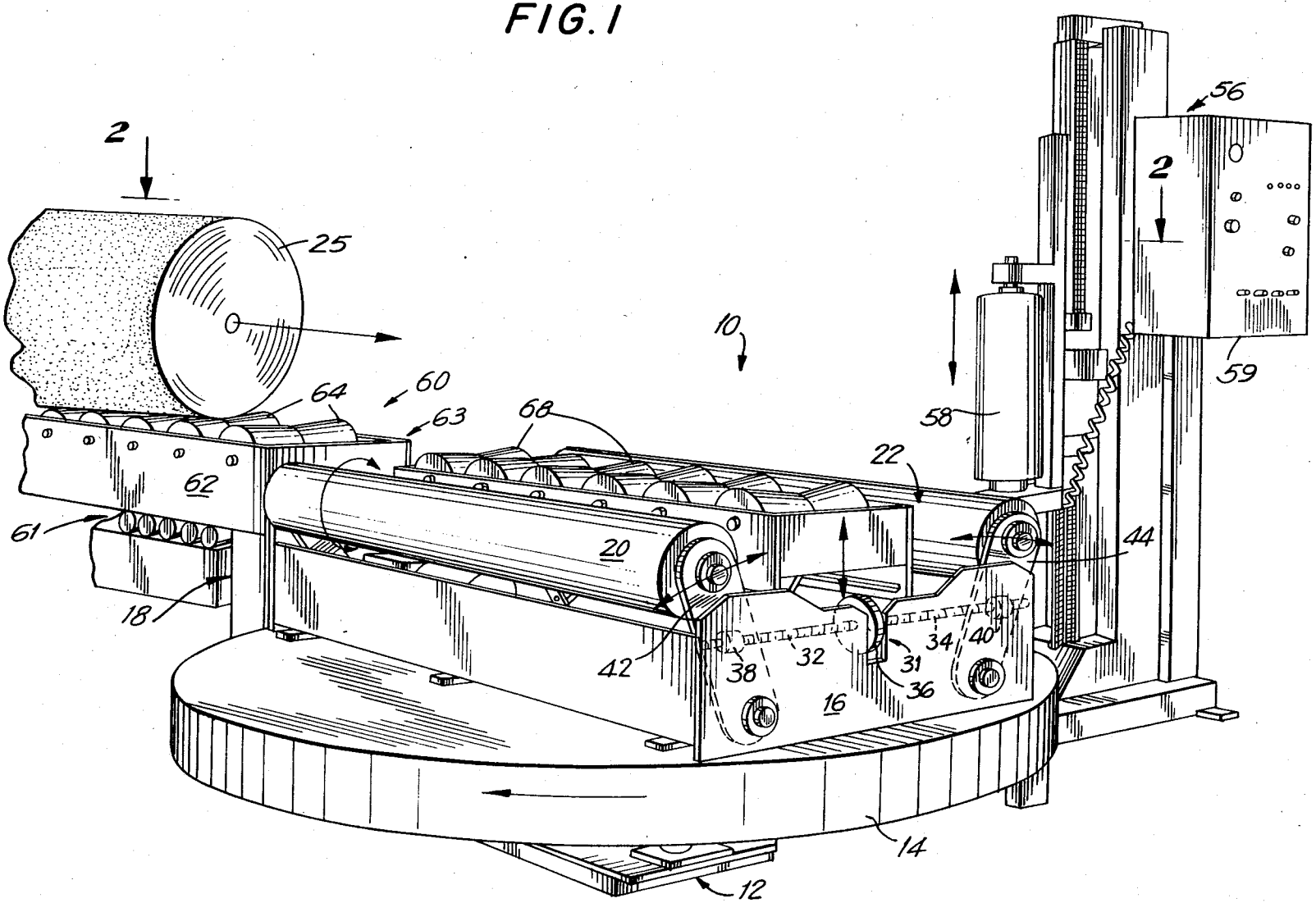
FIG. 1 is a perspective view of the roll wrapping apparatus of the present invention.
Figure 2:
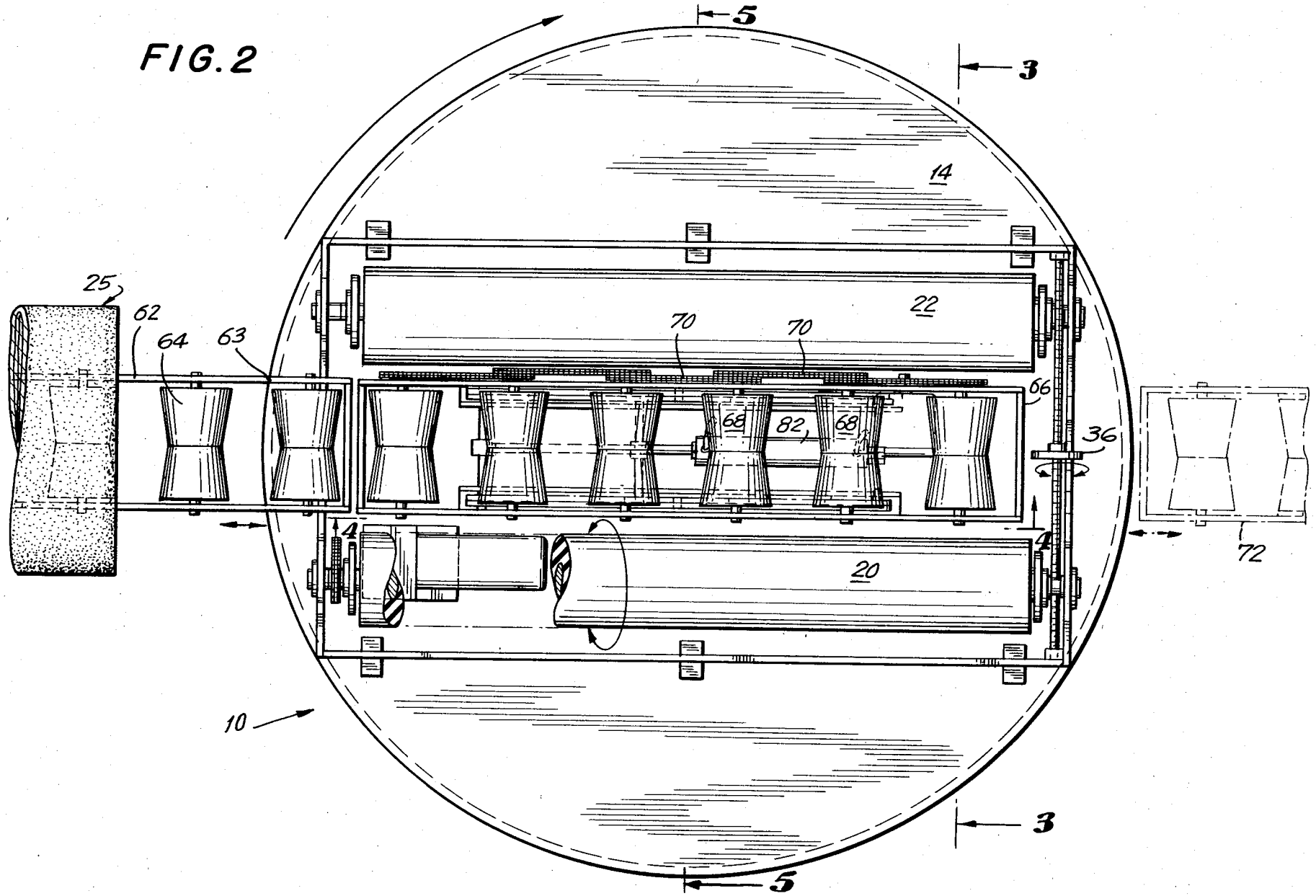
FIG. 2 is a top plan view, of the apparatus of FIG. 1.
Figure 3:
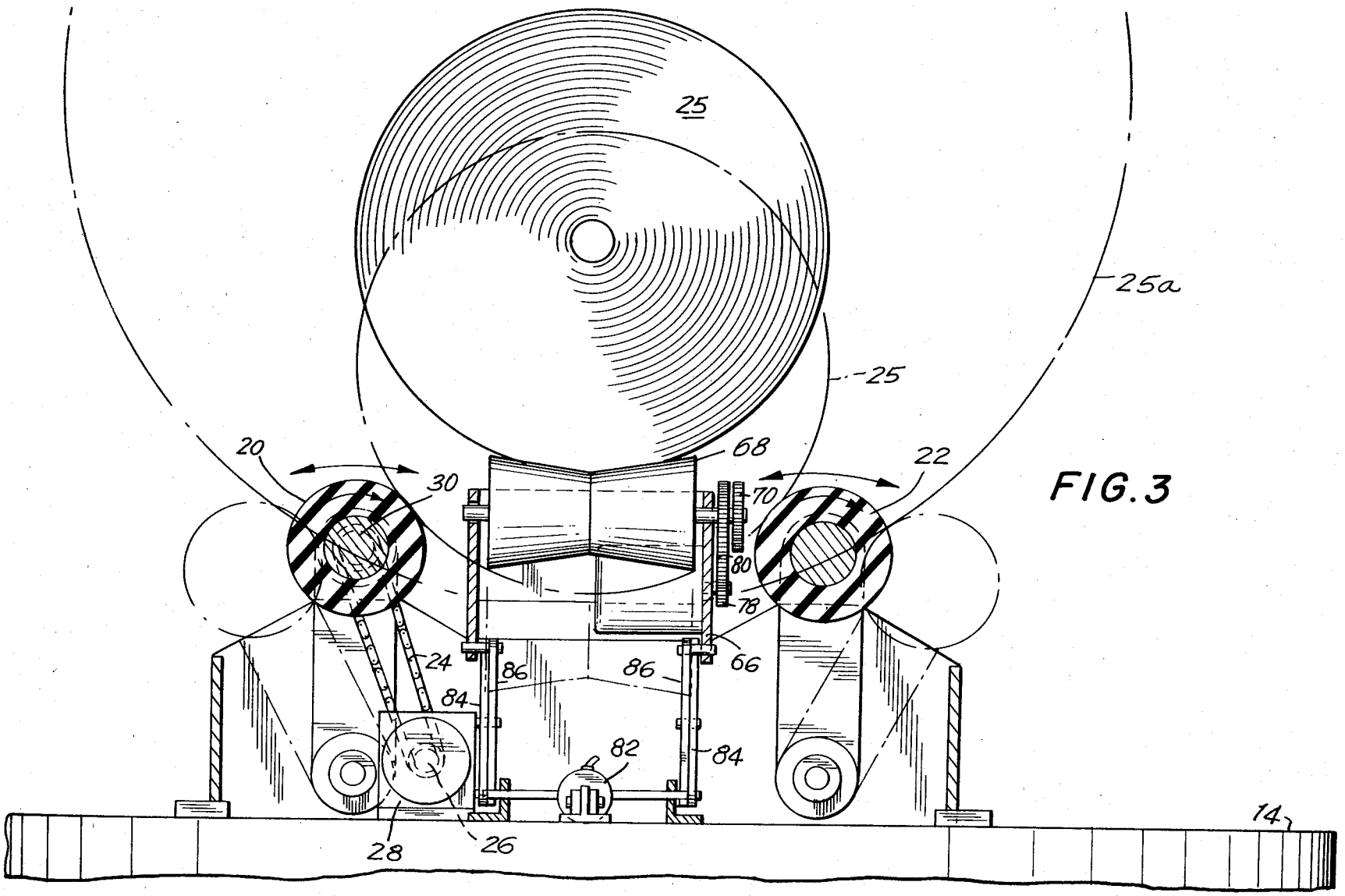
FIG. 3 is a side elevational view taken along lines 3—3 of FIG. 2.

Referring to FIGS. 1 and 2 there is illustrated a roll wrapping apparatus 10 constructed according to the invention. The apparatus includes frame 12 having a platform 14 mounted for rotation thereon about a vertical axis extending substantially through its center. The platform 14 has fixed thereon vertical plates 16 and 18 which support elongated article support rollers 20 and 22 on which an article to be wrapped 25 is positioned for wrapping. Of these support rollers, roller 20 is rotatably driven by roller chain 24 as shown in FIG. 3 which is in turn driven by sprocket 26 attached to reversible motor 28 as also shown in FIG. 3. Thus, it will become clear that rotation of reversible motor 28 in either of its directions will in turn rotate sprocket 26 in the same direction and will correspondingly rotate roller drive chain 24 and sprocket 30 and consequently, article support roller 20 in the same direction. Thus, an article 25 positioned on rollers 20 and 22, when rotated, will cause rotation of roller 22 in a direction opposite the direction of roller 20 and reversal of the direction of roller 20 will cause a corresponding reversal of roller 22 such that it will cause a reversal of roller 22 to the opposite direction.

Also shown in FIGS. 1 and 2 is a conveying system 60 for delivering articles to be wrapped 25 as well as for removal of wrapped articles from the wrapping apparatus 10. The conveying system 60 includes delivery/-removal conveyor 62 which has a number of concave rollers 64 for directing the article 25 toward or away from the wrapping apparatus 10. The conveying system includes a conveyor 66 mounted on turntable 14. This delivery/removal conveyor 62 also includes a lower roller assembly 61, which enables the end portion 63 of the conveyor 62 to move back and forth so as to be positioned adjacent to turntable conveyor 66 for smooth delivery and removal of articles 25.

The turntable conveyor 66 is movable upwardly and downwardly in a vertical direction and is used to place to load 25 on wrapping rollers 20 and 22 for wrapping, as well as for removing the wrapped load from the wrapping rollers 20, 22 and back onto conveyor 62. Conveyor 66 also has a plurality of concave rollers 68. These rollers 68 can be driven to direct the load 25 either to the wrapping apparatus 10 for wrapping, or for conveying the wrapping article away from the wrapping station.

Figure 4:
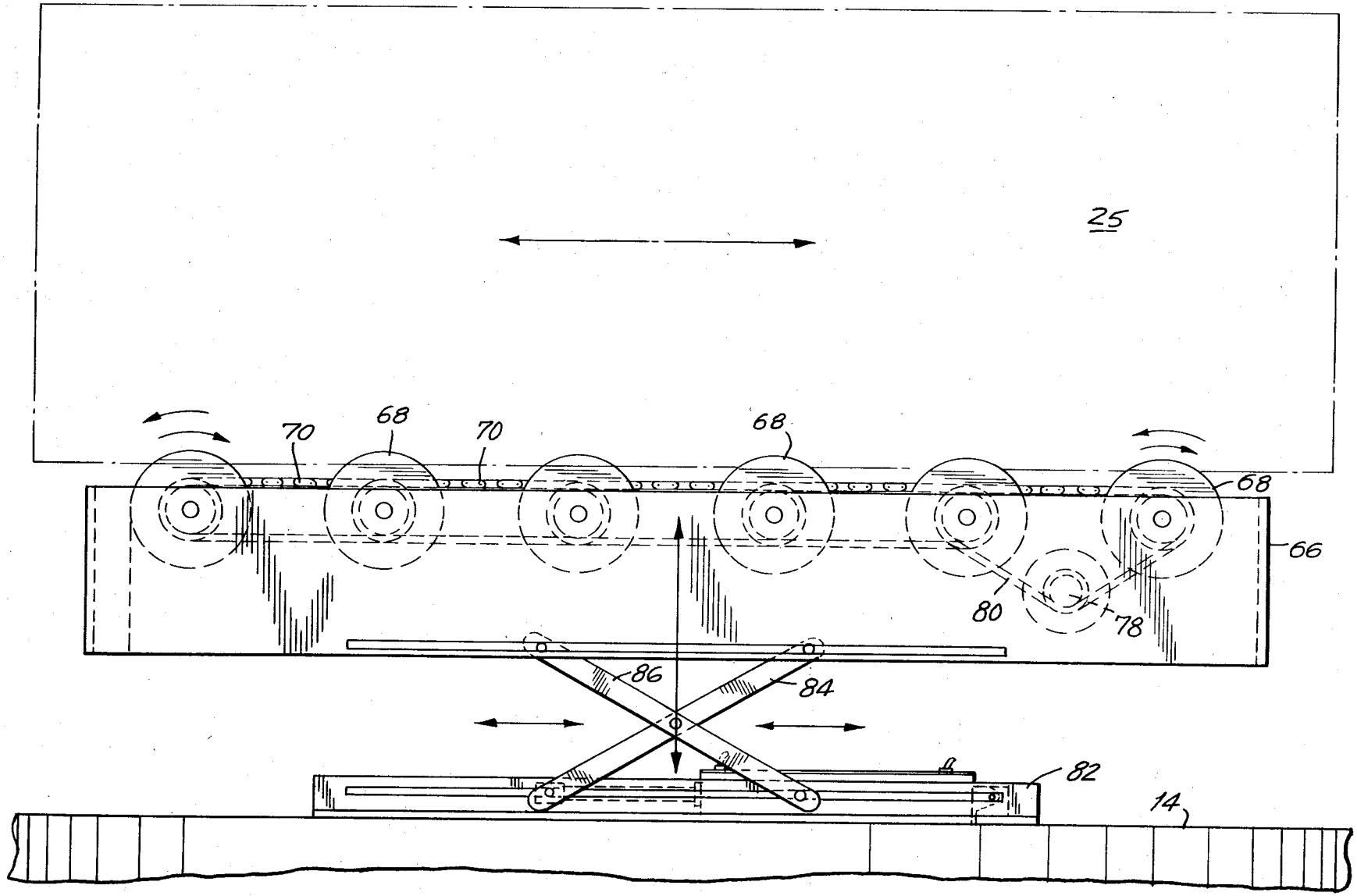
FIG. 4 is a side elevational view, partially in cross-section, taken along lines 4—4 of FIG. 2.

FIG. 4 shows the connection of each pair of rollers 68 by chain assemblies 70. One pair of rollers is driven by a rotatably driven sprocket 78 and chain 80. The sprocket 78 can rotate either in a clockwise or counterclockwise direction and thus the rollers can direct the load either to or away from the wrapping station 10.

Referring now to FIG. 2, load 25 is shown approaching the wrapping system 10. The end 63 of conveyor 62 is shown in adjacent position to turntable conveyor 66. The rollers of conveyor 62 can be driven or can be freely rotating, depending on the desired system. Rollers 68 of conveyor 66 are shown as connected by sprocket and chain assemblies 70 between each adjacent pair of rollers. As mentioned above, the rollers 68 can be driven in either direction to deliver and/or remove the load.

In an alternate arrangement, conveyor 62 can be used to deliver the load 25 to the wrapping system 10, while a second conveyor 72, shown in phantom in FIG. 2, can be used to remove the load. The end of second conveyor 72 can also be moveable to meet turntable conveyor 66 for smooth removal of the wrapped article 25. This facilitates faster continuous roll wrapping and would be desirable for high volume production.

Although the drawings show the only conveyor to be driven as conveyor 66, one skilled in the art would realize that any or all conveyors 62,66,72 can be free rolling (i.e., normally operable) or driven in sequential or alternating fashion in either or both directions, depending upon the results desired.

Referring once again to FIG. 1, rollers 20, 22 can be moved to accomodate loads of different diameter. This is accomplished by providing a threaded rod 31 having two sections, 32 and 34, each having opposite threads, i.e. right hand and left hand, respectively, and a hand operated control wheel 36. The control wheel 36 is used to rotate rod 31 in either of two rotational directions. One end of rod 31 is threadedly engaged with right hand threaded lug (or nut) 38 and the other end 34 is threadedly engaged with left hand threaded lug (or nut) 40. Threaded lug 38 is connected to roller support plate 42 and threaded lug 40 which supports roller 20 is connected to roller support plate 44 which supports roller 22. Thus, manual rotation of hand wheel 36 in one direction will cause the rollers 20 and 22 to move toward each other, and rotation of hand wheel 36 in the other direction will cause the rollers 20 and 22 to move in directions opposite each other. The movement of the rollers by such rotation is equal and opposite and thus maintains the upward support forces provided by the rollers equidistant from the center of the rotating platform, thus preventing the weight of the article from shifting and thereby tilting the apparatus as in prior art devices which merely moved one roller to change the article size capability of the apparatus.

Alternatively, in place of a hand operable control wheel, an electrically actuated or motorized mechanical adjustment system may be used. This would allow the necessary adjustments to be made automatically by an operator stationed remote from the apparatus.

FIG. 4 illustrates the vertical movement of turntable conveyor 66. This can be accomplished by pneumatic cylinder 82 and support arms 84,86. Other means for vertical movement can be used. In particular, air bags, hydraulic means or other mechanical means are also suitable. As the cylinder 82 is extended the support arms 84,86 lower the conveyor 66. Alternately, as the cylinder 82 is retracted, the arms 84,86 raise the conveyor 66. As mentioned above, this asserts in the positioning of the load 25 on the wrapping rollers 20,22.

Figure 5:
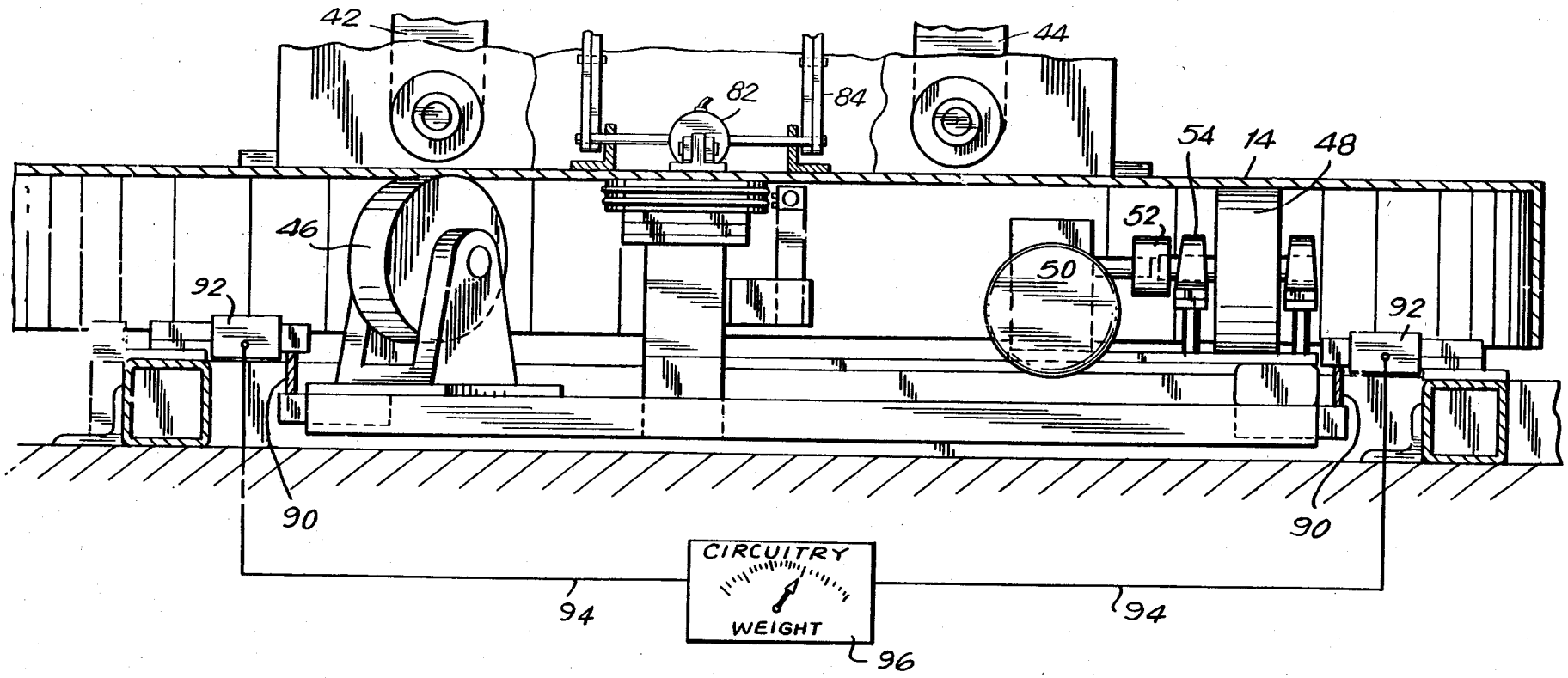
FIG. 5 is a view, partially in cross-section, taken along lines 5—5 of FIG. 2.

Referring now to FIG. 5 there is illustrated a partial cross-sectional view of the apparatus of FIG. 1 and FIG. 2 taken along lines 5—5 of FIG. 2. Rotational platform 14, on which article support rollers 20 and 22 are supported, is supported on a plurality, preferable three, support rollers, two of which are shown at 46 and 48. Roller 48 is driven via motor 50, coupling 52 and gearbox 54. At least roller 48 has a frictional surface which rotatably engages the under surface of platform 14 to thereby rotate it so as to in turn rotate the support rollers 20 and 22 as well as the article to be wrapped, 25, about a vertical axis during the wrapping operation.

Referring once again to FIG. 1 there is shown a section 56 of the apparatus which supports and dispenses the web-type wrapping material. Any web-type wrapping material may be utilized, but preferably film materials as nylon, polypropylene, PVC, polybutylene, polyethylene, or other copolymers or blends thereof are preferred for their superior stretch wrapping capability. As noted previously, other materials known in the art may be used, and these materials would include netting, cloth, paper, etc. In addition, wrapping section 56 may include a roll 58 of such wrapping or netting material, rotatably mounted as shown, for dispensing as required by the rotating article, or it may include a system to pre-stretch the wrapping material such as the system marketed by MIMA INCORPORATED, under the trademark ACCU-STRETCH brand pre-stretch system.

The roll 58 is mounted on a moveable frame 57, which is capable of positioning the roll 58 in the center of the article to be wrapped 25. Also, the roll 58 is mounted on a track (not shown) which allows the roll 58 to be movable in upward and downward directions. This vertical movement is utilized when wrapping articles having large diameters to more efficiently cover the entire article.

Wrapping section 56 also includes control center 58 which displays a control panel 59 having various control buttons or the like as shown, to control the rotation and directions of the various critical components of the apparatus for wrapping articles. This control center may also include weighing the scale readout and/or printout means.

In operation, an article to be wrapped, such as is shown at 25 in FIG. 3, may be a cylindrically configured article such as a roll of carpet, a plurality of tires in face to face relation to form a cylindrical unit, or other such articles, and this article is placed upon the support rollers 20 and 22. If the article is relatively small as shown, the hand wheel 36 is rotated to position support rollers 20 and 22 as shown in FIG. 1. If the article is larger, the handwheel 36 is correspondingly rotated to a position which accommodates large articles as shown by the phantom lines at 25*a* in FIG. 3. It is significant to note that for any article size, the center of gravity of the article remains fixed with respect to the support rollers 20 and 22 as well as rotating platform 14 and thus never shifts to either side of the rotating platform.

Once article 25 is positioned for wrapping, the platform 14 is rotated by actuating the appropriate controls which control platform drive motor 50 (shown in FIG. 5) thereby causing the article to be rotated therewith about a vertical axis. In addition, an appropriate control which causes rotation of roller drive motor 28, roller chain 24 and support roller 20, which in turn rotates article 11 causing support roller 22 to also rotate in the same direction as support roller 20. The article thus rotates about a horizontal axis extending centrally thereof which axis is also rotating about the same central vertical axis about which platform 14 is rotating.

While the article is thus rotating about two axes, web-type wrapping material is dispensed from the wrapping section 56 either in stretched or non-stretchable condition as may be desired, so as to be wrapped about the article. As may be desired for a particular article, the direction of rotation of the roller 20 may be selectively reversed, thereby reversing the rotational direction of the workpiece as well as roller 22, thus causing the plastic wrapping material to assume a crisscross pattern about the article with the web-type wrapping material in overlapped condition. The extent of overlap of the wrapping material is controlled by the rotational directions selected and the relative rotational speeds which are controlled through control panel 59.

Referring now to FIG. 5 there is illustrated a unique feature of the present nvention which facilitates automatic weighing of the article, thus eliminating a separate step in the wrapping and weighing process. Rotational platform 14 is suspended from frame 12 by suitable suspension means such as cables 90 which are in turn connected to corresponding load cells 92. Two or more cables and corresponding load cells are used, however, at least three or more cables and load cells are preferred. Various load cell weight measuring techniques may be used, and the load cells may be hydraulic, mechanical or electrical. Electrical load cells, however, appear to be the most advantageous for this invention.

Appropriate electrical circuitry 94 communicates with a suitable electrical bridge (i.e. Wheatstone type), which in turn provides a signal which is proportional to the weigh on the load cells. Thus, before the article is positioned on the apparatus, the initial weight of the rotatable platform 14 is removed from the weight reading (i.e. denoted as "tare") leaving a reading of zero weight on the dial 96. When the article is positioned for wrapping and later, is fully wrapped, the final weight of the wrapped article is provided on the scale, thus facilitating wrapping and weighing in a single operation. As noted previously, in the prior art, such steps were performed separately.

Figure 6:
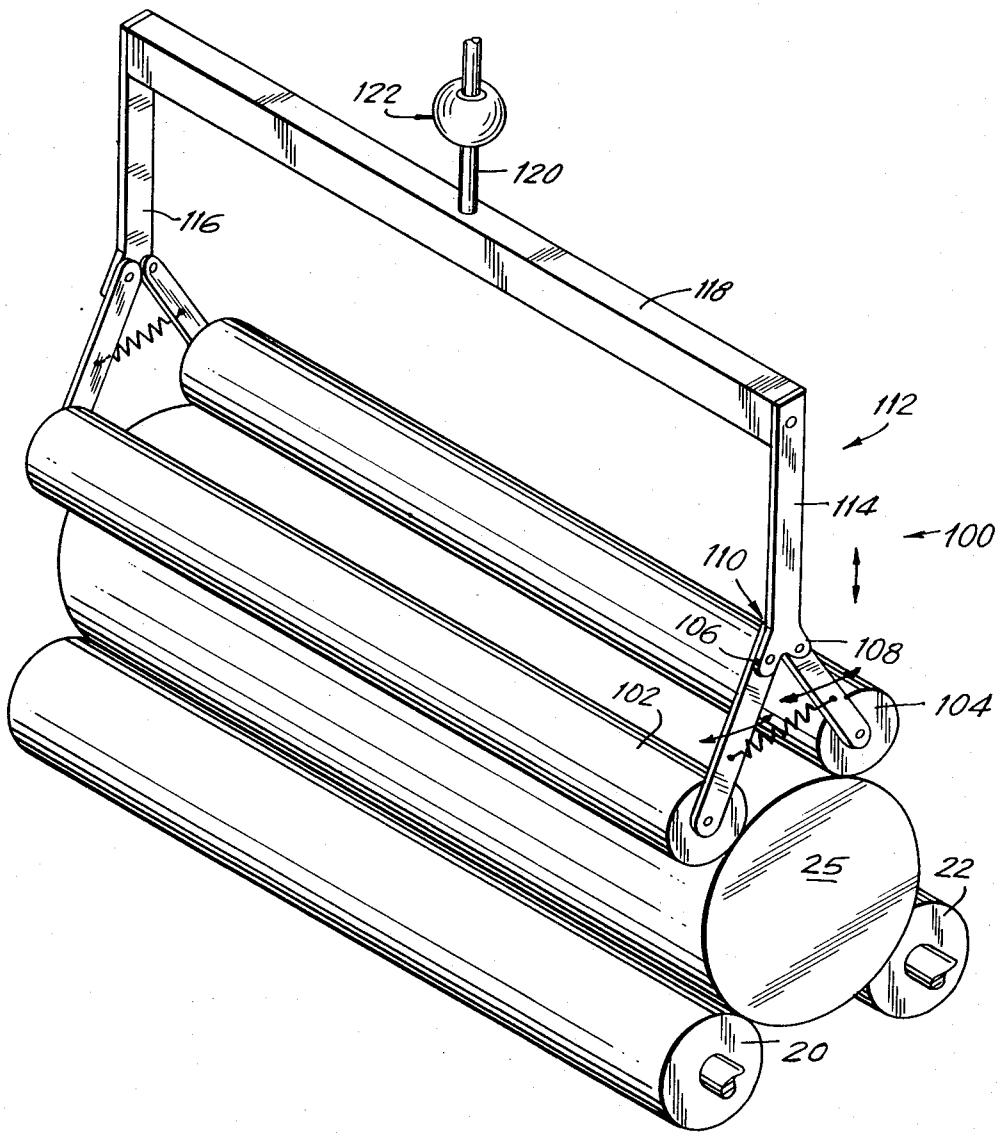
FIG. 6 is a perspective view of an optional apparatus for stabilizing the load during wrapping.

FIG. 6 illustrates an optional apparatus 100 for stabilizing the load 25 during wrapping. This apparatus 100 comprises stabilizing rollers 102, 104 connected together by arm members 106, 108 which arm members join at pivotable point 110. As shown in FIG. 6, spring means 116 provides spring tension on arms 106, 108. This enables the rollers 102, 104 to be movable to conform to the outer diameter of the load 25 in a manner so as to impart stabilizing forces thereupon.

These roller arm members 106, 108 and pivot 110 are used on each end of the rollers 102, 104 and are connected to frame 112 by member 114. This frame 112 is supported by an overhead support structure (not shown) and is connected thereto by a joint 118 which is capable of rotating as well as supporting the weight of the rollers 102, 104.

It will be appreciated that my invention facilitates an improved wrapping and transporting apparatus and method which no only provides improved wrapping, but which eliminates time consuming delivery of articles to be wrapped to the wrapping apparatus and the removal of the wrapped articles therefrom.

We claim:

1. An apparatus for transporting and wrapping articles which comprises:

conveyor means for transporting articles to a wrapping apparatus, said apparatus including:

(a) a frame;

(b) a platform rotatably mounted on said frame and means for rotating said platform about a substantailly vertical axis;

(c) at least two elongated support rollers mounted in spaced relation on said rotatable platform for rotation about substantially horizontal axes extending therethrough;

(d) a supply of web-type wrapping material mounted on said frame, said wrapping material supply being postioned and adapted for dispensing and wrapping about an article supported on said horizontally rotatable rollers as said platform rotates about a vertical axis;

(e) means for selectively moving said supply of wrapping material in an upward and downward direction so as to selectively vary the vertical height at which said wrapping material is dispensed from said wrapping material supply;

(f) means for rotatably driving at least one of said substantially horizontal rollers in either of two directions of rotation such that an article to be wrapped rotates about a substantially horizontal axis when said driven support roller is rotated in a first direction and said rotating article engages said other horizontal support roller and thereby rotates said other support roller in the same direction as said first driven roller;

(g) means for selectively varying the spacing between said horizontal rotatable support rollers by substantially equal and opposite movements respectively toward or away from each other to maintain said article in substantially the same location with respect to said frame and thereby providing capability to support articles of numerous sizes and weights; and (h) weighing means positioned between said rotatable platform and said frame for generating a signal which corresponds to the weight of an article while said article is on said support rollers positioned on said frame so as to thereby provide the weight of the article.

2. The apparatus according to claim 1 wherein said means for selectively moving said supply of wrapping material further comprises means to selectively move said supply of wrapping material in upward and downward directions so as to selectively vary the vertical height at which said wrapping material is dispensed from said wrapping material supply.

3. The apparatus according to claim 1 wherein said means for rotatably driving said at least one of said horizontal rollers is capable of selective driving rotation in clockwise or counter clockwise directions.

4. The apparatus according to claim 1 further comprising means for stabilizing the article when positioned upon the support rollers during the wrapping operation.

5. The apparatus according to claim 4 wherein said stabilizing means comprises at least two rollers mounted above said support rollers and capable of rotation about a substantially vertical axis.

6. The apparatus of claim 1 wherein said means for selectively varying the spacing between said support rollers is a rod member having two equal sections with opposite threads; each section of said rod member being threadedly engaged with means connected to a roller support plate.

7. The apparatus according to claim 1 wherein said means for providing said weight indication is a plurality of load cells connected to said apparatus and to an electrical circuit.

8. The apparatus according to claim 7 wherein said plurality of load cells are equally distributed with respect to said rotatable platform.

9. The apparatus according to claim 8 wherein said load cells and said electrical circuitry comprises means for indicating the weight of said rotatable platform and the article positioned thereon.

10. The apparatus according to claim 9 wherein said load cells and said electrical circuitry comprises means for initially subtracting the weight of said platform and related components from said total indicated weight thereby indicating the weight of said article.

11. The apparatus according to claim 1 further comprising second conveyor means for transporting the articles thereby wrapped away from said wrapping apparatus.

12. The apparatus according to claim 11 wherein each said conveyor means is comprised of a plurality of conveyor rollers connected to form a conveyor, each conveyor roller having a generally concave outer configuration in a plane perpendicular to the conveying direction for supporting a generally cylindrical article to be wrapped for transport in a direction parallel to the axis of the article.

13. The apparatus according to claim 12 wherein each of said rollers has an hourglass cross-sectional configuration in a plane perpendicular to the conveying direction.

14. The apparatus according to claim 13 wherein each of said rollers is rotatably supported by bearing means.

15. The apparatus according to claim 14 wherein each of said rollers is free rolling on said bearing means.

16. The apparatus according to claim 15 wherein each of said rollers is rotatably driven.

17. The apparatus according to claim 16 wherein each of said driven rollers is rotatably driven by either drive chain means or drive belt means.

18. The apparatus according to claim 17 wherein said drive chain means is driven by rotatably driven sprocket means.

19. The apparatus according to claim 17 wherein said drive belt means is driven by rotatably driven pulley means.

20. The apparatus according to claim 1 wherein said conveyor means comprises a first conveying section for transporting articles to be wrapped to said wrapping apparatus and for conveying a wrapped article away from said wrapping apparatus, and a second conveying section mounted upon said rotatable platform for positioning the article to be wrapped upon said elongated support rollers and for removing the wrapped article from said support rollers.

21. The apparatus according to claim 11 wherein said first conveyor means comprises a first conveying section for transporting articles to be wrapped to said wrapping apparatus, and a second conveying section which is mounted upon said rotatable platform for positioning the article to be wrapped upon said elongated support rollers and for removing the wrapped article from said support rollers, and said second conveyor means comprises a conveying section for transporting the wrapped articles away from said wrapping apparatus.

22. The apparatus according to claim 12 further comprising means for positioning said second conveying section of said first conveyor means in preselected locations below and above said elongated support rollers to facilitate conveying and positioning of the article to be wrapped upon said elongated support rollers, and for removing and conveying said wrapped article from said elongated support rollers.

23. The apparatus according to claim 22 wherein said second conveying section of said first conveyor means is fixed medially between said support rollers.

24. The apparatus according to claim 23 wherein said web-type wrapping material is nylon, polypropylene, PVC, polybutylene, polyethylene, or copolymers or blends thereof, or cloth.

25. The apparatus according to claim 23 wherein said web-type wrapping material is paper or cardboard.

26. A method for roll wrapping articles or the like which comprises:

(a) transporting articles to be wrapped upon conveyor means to a wrapping station; and (b) wrapping said aritcles at said wrapping station by:

i. supporting an article on at least two support rollers, at least one of said support rollers being rotatably driven, the other support roller being supported for rotation about a horizontal axis;

ii. selectively varying the spacing between said support rollers by substantially equal and opposite movements respectively toward or away from each other to support said article while maintaining said article in substantially the same location with respect to said support rollers;

iii. supporting said support rollers on a rotatable platform, selectively driven by motor and drive means connected thereto;

iv. providing a supply of web-type wrapping material positioned for dispensing and wrapping about the article;

v. rotating said platform and said article support rollers and the artilce about a substantially vertical axis;

vi. selectively rotating said driven support roller so as to rotate the article about a substantially horizontal axis, and said other support roller therewith;

vii. selectively moving said supply of wrapping material in upward or downward directions so as to selectively vary the vertical height at which said wrapping material is dispensed from said wrapping material supply;

vii wrapping the web type material around the article so as to provide a criss-cross wrapped pattern of wrapping material about said article; and viii. imultaneously weighing said article while said article is on said support rollers, by weighing means comprising load cells and circuitry located on, and connected to, said platform means to facilitate wrapping and weighing in a single operation.

27. The method according to claim 26 wherein said step of providing a supply of web-type wrapping material further comprises selectively moving said supply in upward and downward directions so as to selectively vary the vertical height at which the supply material is dispensed.

28. The method according to claim 26 wherein said step of selectively rotating said driven support roller further comprises reversing the rotational direction of said driven article support roller as said article rotates about the substantially vertical axis as said web-type wrapping material is wrapped therearound.

29. The method according to claim 26 which further comprises stabilizing the article when positioned upon the support rollers during the wrapping step.

30. The method of claim 26 wherein the spacing between the support rollers is varied by automatically or manually rotating in a predetermined direction a rod member having two substantially equal sections each having relatively opposite threads; each section of said rod member being threadedly engaged with means connected to a roller support plate to cause said support rollers to move toward or away from each other.

31. The method according to claim 26 wherein the step of supplying a signal comprises indicating the weight of the platform and article and stubstracting the weight of said platform therefrom to directly obtain the weight of the article.

32. The method according to claim 26 which further comprises transporting the articles thereby wrapped away from said wrapping station.

33. The method according to claim 26 which further comprises positioning an article to be wrapped upon said support rollers for wrapping and removing the article thereby wrapped from said support rollers.

34. The method according to claim 33 wherein the step of positioning the article to be wrapped comprises moving conveying means in an upward and downward direction.

* * * * *